US007591120B2

(12) United States Patent
Hafker et al.

(10) Patent No.: US 7,591,120 B2
(45) Date of Patent: Sep. 22, 2009

(54) APPARATUS FOR PRODUCING CIGARETTE PACKS PROVIDED WITH COUPONS

(75) Inventors: Thomas Hafker, Langwedel (DE); Jens Schmidt, Grasberg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 376 days.

(21) Appl. No.: 10/595,202

(22) PCT Filed: Sep. 7, 2004

(86) PCT No.: PCT/EP2004/009937

§ 371 (c)(1),
(2), (4) Date: May 11, 2006

(87) PCT Pub. No.: WO2005/037651

PCT Pub. Date: Apr. 28, 2005

(65) Prior Publication Data

US 2007/0028934 A1 Feb. 8, 2007

(30) Foreign Application Priority Data

Sep. 25, 2003 (DE) ..... 103 44 675

(51) Int. Cl.
*B65B 61/26* (2006.01)
*B65B 61/00* (2006.01)

(52) U.S. Cl. ..... 53/64; 53/131.2; 53/136.1; 198/351; 414/416.07; 414/794.4; 414/799

(58) Field of Classification Search ..... 53/64, 53/140, 173, 168, 131.2, 131.3, 135.1, 136.1, 53/136.3, 136.4, 536, 540, 580, 586, 590, 53/245, 249–251, 281, 117, 520, 282; 198/351, 198/367.1, 363, 459.6; 414/403, 416.01, 414/416.07, 794.4, 799, 927

See application file for complete search history.

(56) References Cited

U.S. PATENT DOCUMENTS

| | | | | |
|---|---|---|---|---|
| 3,392,892 | A * | 7/1968 | Rainbow et al. | 53/536 |
| 3,490,196 | A * | 1/1970 | Sorensen | 53/64 |
| 3,672,118 | A * | 6/1972 | De Jong et al. | 53/536 |
| 3,786,944 | A * | 1/1974 | Daigle et al. | 198/351 |
| 4,605,459 | A * | 8/1986 | Voltmer et al. | 53/136.1 |
| 4,907,941 | A | 3/1990 | Focke et al. | |

(Continued)

FOREIGN PATENT DOCUMENTS

| | | | |
|---|---|---|---|
| DE | 198 27 412 | A1 | 12/1999 |
| DE | 199 26 7134 | A1 | 12/2000 |
| DE | 699 00 225 | T2 | 12/2001 |
| DE | 101 00 248 | A1 | 7/2002 |
| EP | 965 523 | A1 | 12/1999 |
| EP | 1072516 | A1 * | 1/2001 |

(Continued)

*Primary Examiner*—Stephen F Gerrity
(74) *Attorney, Agent, or Firm*—Sughrue Mion, PLLC

(57) ABSTRACT

During the production of (cigarette) packs by packers (13), the pack, depending on its configuration, has printing carriers, namely coupons which may be folded a number of times, added to it. These are produced by a coupon-production device (16) in a coupon arrangement (15) and are introduced into containers, namely magazines (20), in a filling station (18). A number of these magazines, in turn, which corresponds to requirements is kept on vehicles, namely transporting carts (42, 43), in order to be fed to the packer (13). The relevant machines and subassemblies are connected to a central control unit (91) which defines the quantity of coupons which are to be produced and causes the magazines (20) and/or the transporting carts (42, 43) to be coded, with the result that the supply of the packers (13) with coupons is controlled in accordance with the batch of packs which is to be produced.

12 Claims, 7 Drawing Sheets

U.S. PATENT DOCUMENTS

| | | | | |
|---|---|---|---|---|
| 4,987,809 | A | 1/1991 | Price | |
| 5,328,322 | A * | 7/1994 | Neri | 414/927 |
| 6,173,551 | B1 * | 1/2001 | Bowman et al. | 53/131.4 |
| 6,701,218 | B2 * | 3/2004 | Koike et al. | 53/135.1 |
| 6,751,934 | B2 * | 6/2004 | Focke et al. | 53/64 |
| 2002/0162299 | A1 * | 11/2002 | Focke et al. | 53/168 |
| 2003/0123962 | A1 * | 7/2003 | Mikulic et al. | 414/403 |
| 2004/0164483 | A1 | 8/2004 | Focke et al. | |

FOREIGN PATENT DOCUMENTS

| | | | |
|---|---|---|---|
| EP | 1 097 872 | A1 | 5/2001 |
| EP | 1 125 843 | A1 | 8/2001 |
| EP | 1 256 539 | A2 | 11/2002 |
| JP | 02109827 | A * | 4/1990 |
| JP | 03124615 | A * | 5/1991 |
| JP | 04215919 | A * | 8/1992 |

* cited by examiner 60
60
58
59
20
59
55
69/70
26
18
VI
55
69/70
27
V
68
68
66
VII
VII
89
47
53
58
89
50
51
52
67
20
48
67
49
V
20
42
43

APPARATUS FOR PRODUCING CIGARETTE PACKS PROVIDED WITH COUPONS

BACKGROUND OF INVENTION

The invention relates to a method of producing (cigarette) packs which are provided with at least one blank, in particular with a coupon which is folded a number of times, the blanks or coupons being produced by a coupon-production means and fed to a packaging machine. The invention also relates to an apparatus for implementing the method.

During the production of cigarette packs, it is desirable or necessary for the latter to be provided with separate blanks. These may be (tax) revenue stamps which are to be applied to the pack in accordance with regulations. Alternatively or additionally, printing carriers, namely coupons, may be added to the pack. These may be folded a number of times in order to increase the size of the surface areas which can carry printing. The design and method of producing such folding coupons is known in principle. The operations of introducing coupons and other printing carriers into a container, namely into a magazine, and of fitting this in a magazine carousel in the region of the packaging machine also belong to the prior art (EP 1 125 843 A1). The coupons are removed one after the other in the downward direction from the shafts and fed to the packs.

SUMMARY OF THE INVENTION

The object of the invention is to coordinate the handling of the blanks or coupons with the production of the packs such that the necessary quantity of coupons is automatically made available, with little manual intervention, to the packaging machine.

In order to achieve this object, the method according to the invention is characterized by the following features:

a) following the coupon-production means, the coupons are introduced into containers—magazines—to form stacks, b) a number of containers, with correspondingly designed coupons, which corresponds to a batch of (cigarette) packs which is to be produced are provided with a marking, in particular with a readable (bar) code, c) in the region of the packaging machine, the marking or the bar code of a container—magazine—is checked in respect of correct assignment, in particular by a reader.

Accordingly, the special feature of the invention is that the coupons produced in a coupon-production means assigned to a plurality of packaging machines are collected, and introduced into magazines, in the immediate vicinity of the packaging machines. The magazines are supplied to the packaging machine, as required, by a conveyor, in particular by a transporting vehicle.

According to the invention, a separate coupon arrangement thus comprises a coupon-production means, a distributor system for the coupons and a filling station. A plurality of coupons are produced simultaneously in one operating cycle, in a state in which they are distributed in the transporting direction, with the result that individual coupons following one after the other arrive at the filling station and are introduced into a respective magazine which is kept for this purpose.

One special feature resides in the coordinated control of the coupon arrangement, of the conveyors and of the packaging machines by preferably a central computer. The latter receives the data regarding the (cigarette) packs which are to be produced. The requirements for packaging material and coupons are determined therefrom. The computer then controls the production of the coupons and the availability thereof in accordance with the requirements for each packaging machine.

BRIEF DESCRIPTION OF THE DRAWINGS

Further details of the invention are explained more specifically hereinbelow with reference to exemplary embodiments of the arrangement for handling labels or coupons. In the drawings.

DETAILED DESCRIPTION OF DRAWINGS

Figure 1:
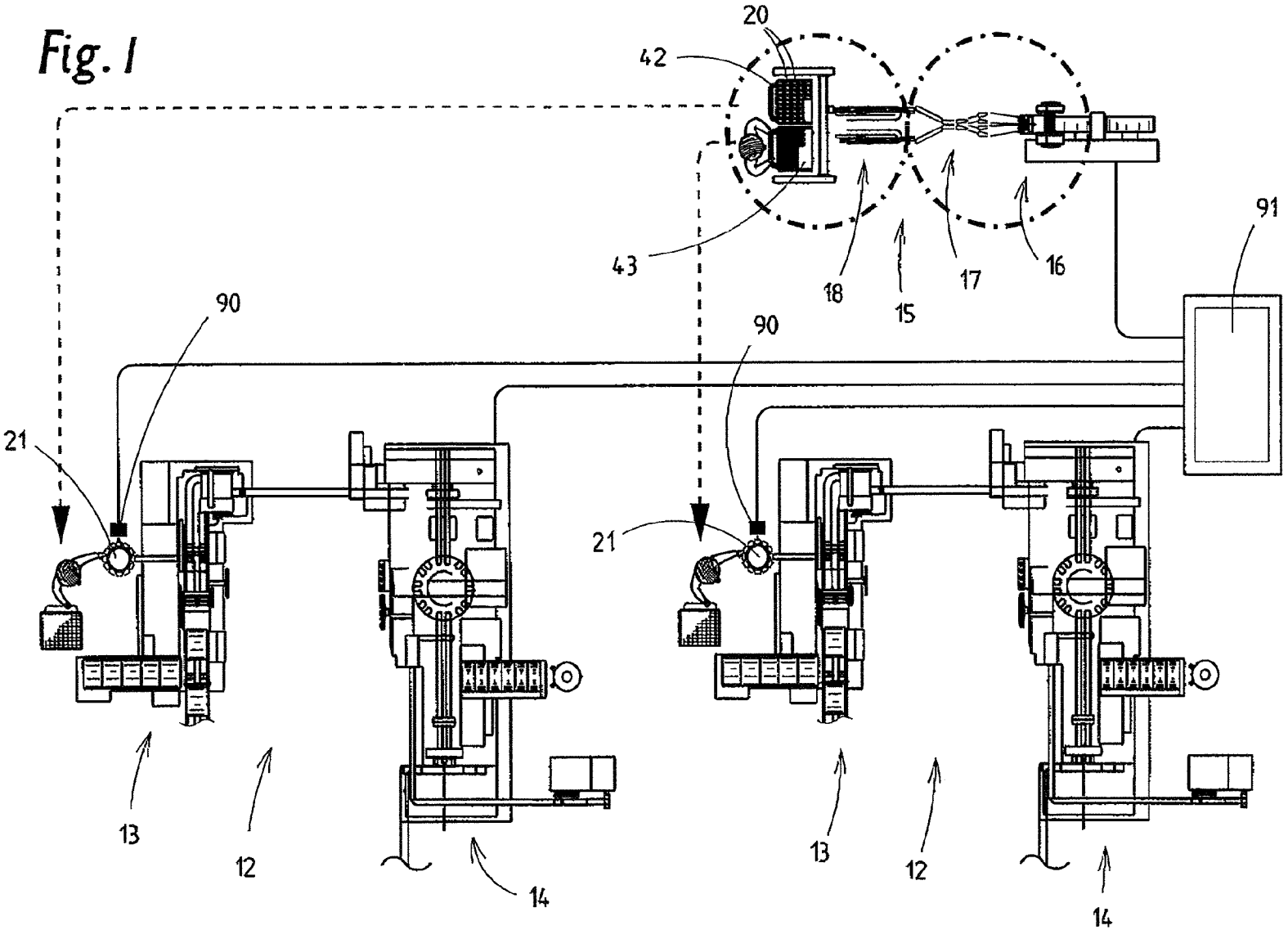
FIG. 1 shows a schematic plan view of an installation for producing (cigarette) packs.
Figure 2:
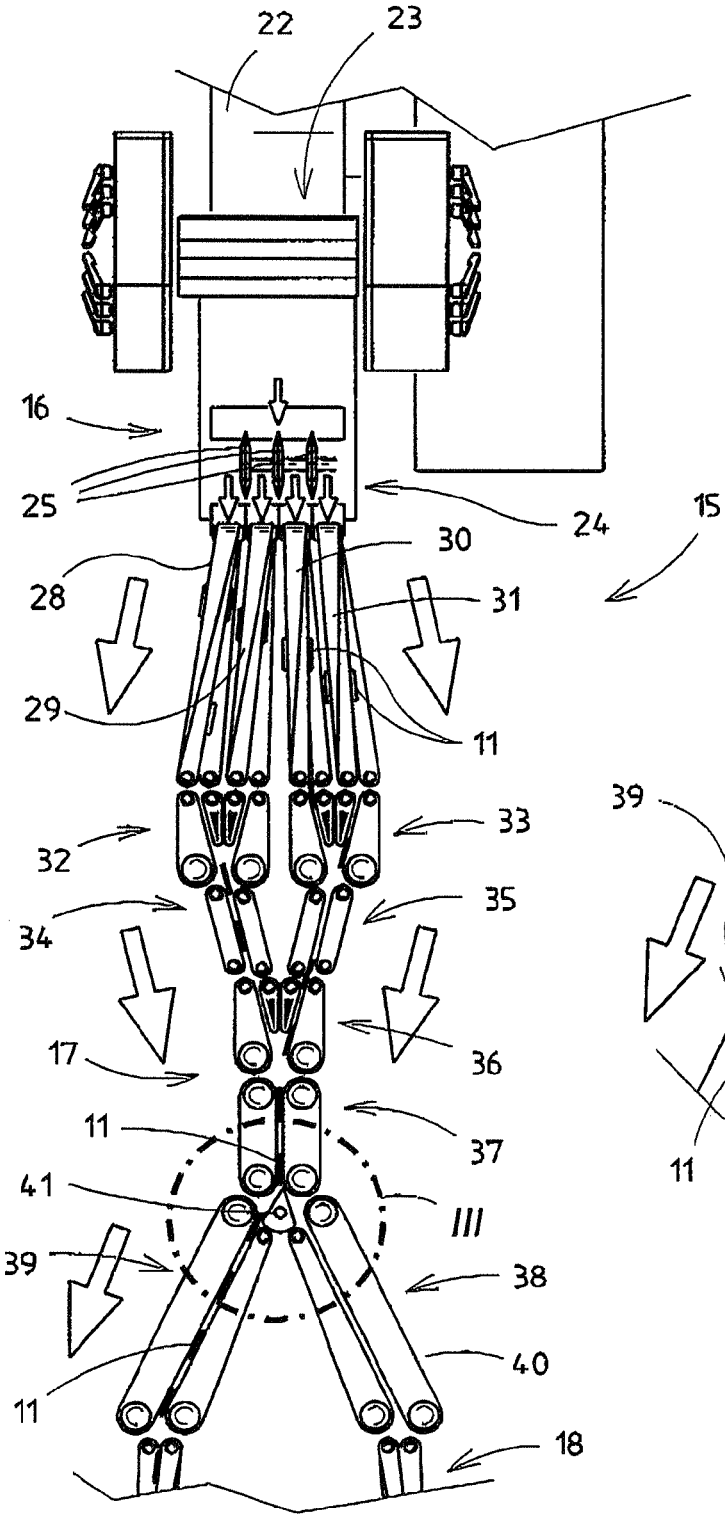
FIG. 2 shows likewise in plan view, and on an enlarged scale, a detail of the arrangement which is marked II in FIG. 1.
Figure 3:
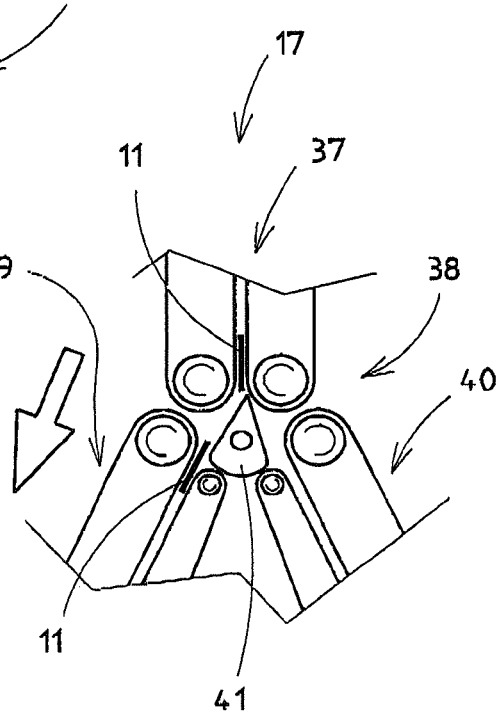
FIG. 3 shows, on an enlarged scale, a detail of an apparatus for handling coupons which is marked III in FIG. 2.

The exemplary embodiments illustrated in the drawings involve the production of (cigarette) packs and the production and handling of blanks, namely coupons 11 which are folded a number of times and are made of paper or similar material. The packs are produced and provided with the blank or coupon 11 in the region of a packaging installation 12. FIG. 1 shows a configuration with two packaging installations 12. Each of these packaging installations 12 comprises a packer 13 and a machine for applying an outer wrapper made of film, a so-called cellophane wrapper 14. In this case, the pack may be designed such that the coupon 11 is applied to the outside of the pack and a film is folded, with the coupon 11, around the outside of the pack.

The packaging installation 12 is assigned an arrangement for producing and handling the coupons 11, namely a coupon arrangement or assembly 15. The latter is separate from the packaging installation 12, in particular is spaced apart therefrom, but such that the coupons 11 can be fed to the packaging installation 12 via expedient conveying paths.

The coupon arrangement 15, which is common, in particular, to a plurality of packaging installations 12, essentially comprises a production subassembly, namely a coupon-production means 16, a distributor system 17 and a filling station 18. In the region of the filling station 18, the blanks or coupons 11 are introduced into elongate containers, namely into shaft-like magazines 20, to form coupon stacks 19. These magazines, in turn, are transported to the packaging installation 12 and are kept there in the region of the packer 13 for processing purposes. In the case of the present exemplary embodiment, each packer 13 is assigned a magazine carousel 21. The filled magazines 20 are inserted into the same. The packer 13 removes the coupons 11 one after the other from the magazines 20 in accordance with pack production. The magazine carousel 21 is preferably designed in accordance with EP 1 125 843.

In the case of the present exemplary embodiment, the coupons 11 are formed in a number of layers by corresponding folding. For this purpose, a web 22 of the material, in particular made of paper, is led through a folding subassembly 23 and folded a number of times in the region of the same. The folding subassembly 23 is known as a buckle folder. The web 22 is prepared by preliminary folding and by way of the folding subassembly 23 such that following the folding subassembly 23, in the region of a severing means 24, in each case four coupons 11 which are located one beside the other in the direction transverse to the conveying direction are produced simultaneously, to be precise by three severing cutters 25 located one beside the other.

The simultaneously produced (four) coupons 11 are transferred to the distributor system 17 immediately upon completion. This distributor system comprises a plurality of interacting endless conveyors and directing means. Coordination results in the coupons 11 being transported separately, that is to say individually, one after the other and then being distributed, to form coupon stacks 19, over (two) filling subassemblies 26, 27 of the filling station 18.

Each of the coupons 11 located one beside the other is assigned a conveyor, namely a receiving belt 28, 29, 30, 31, on the outlet side of the coupon-production means 16. On the one hand, these conveyors move the coupons 11, during transportation, from a horizontally oriented starting position into a vertical position on the outlet side. For this purpose, the receiving belts 28 . . . 31 are twisted, namely with horizontally oriented deflecting rollers on the inlet side of the coupons 11 and upright deflecting rollers on the outlet side.

Furthermore, the relative position of the coupons 11 is changed during transportation, to be precise by virtue of different conveying characteristics and/or conveying speeds of the receiving belts 28 . . . 31. Deceleration or acceleration results in the coupons 11 being offset in the transporting direction, with the result that the simultaneously fed (four) coupons 11 arrive one after the other on the outlet side of the belts 28 . . . 31. In the case of the example shown, the border-side receiving belt 28 is driven at a lower speed than the adjacent receiving belt 29, etc.

Following the receiving belts 28 . . . 31, the coupons 11 are combined by intermediate conveyors 32, 33, in the first instance, on two conveying paths. In each case two coupons 11, in the present case those from the receiving belts 28, 29, are fed to the common intermediate conveyor 32 and the coupons 11 from the other two receiving belts 30, 31 are fed to the second intermediate conveyor 33. The intermediate conveyors 32, 33 have two pairs of endless conveyors on the entry side, these endless conveyors converging, that is to say coming together, in the conveying direction. The coupons 11, which arrive one after the other in each intermediate conveyor 32, 33, are transferred to a common collecting conveyor 36 via connection conveyors 34, 35, which likewise converge in relation to one another. This collecting conveyor is designed analogously to the intermediate conveyors 32, 33 and leads the coupons 11, which arrive in two paths, by way of converging conveying paths into a common movement path, and to an entry conveyor 37 of a distributor 38, which is designed in a particular manner. This distributor transfers the incoming coupons 11 alternately to one filling subassembly 26, 27 or the other in order to form the coupon stacks 19.

The distributor 38 is designed in a particular manner and has the task of feeding the individually arriving coupons 11, which follow one after the other, to one filling subassembly 26, 27 or the other of the filling station 18. For this purpose, the entry conveyor 37 (comprising two upright belts butting against one another) is followed by two diverging conveying units, namely (pairs of) transfer conveyors 39, 40. Each of these transfer conveyors 39, 40 leads (indirectly) to a filling subassembly 26, 27. The transfer of the coupons 11 from the entry conveyor 37 to one transfer conveyor 39, 40 or the other can be adjusted, to be precise preferably in a controlled manner in accordance with requirements. For this purpose, a diverter or a directing means 41 is arranged in the region where the coupons are transferred to the transfer conveyors 39, 40, namely in the region of a gap which is produced here. The directing means 41 is of more or less triangular design here and can be pivoted about a vertical axis of rotation. This results in lateral guide surfaces which, depending on the position of the directing means 41, connect the entry conveyor 37 to one transfer conveyor 39, 40 or the other in order to guide the coupons 11 correspondingly.

The filling station 18 and, in particular, the filling subassemblies 26, 27 constitutes/constitute a special feature. In the region of the filling station 18, on the one hand, the coupon stacks 19 are formed and introduced into the magazines 20. Furthermore, the filled magazines 20 are transferred to a conveyor in order to be transported to one packer 13 or the other.

In the case of this exemplary embodiment, the coupon or magazine conveyors are designed as transporting carts 42, 43. These run on wheels and, here, can be displaced by hand. Each transporting cart 42, 43 comprises an undercarriage 44 and a bearing means for the upright magazines 20, comprising a bearing plate 45 and upright, lateral supporting walls 46, which are arranged in a U-shaped manner, such that a side which is directed toward the filling subassemblies 26, 27 is open. The magazines 20 are positioned in rows one beside the other on the bearing plate 45. A quantity of magazines 20 or coupons 11 which corresponds to the respective requirements is fed to the respectively predetermined packer 13 with the aid of the transporting cart 42, 43, in the present case by way of an operator (machine controller). The latter inserts the magazines 20 into a magazine carousel 21 in the region of the packer 13.

The filling station 18 is designed such that two transporting carts 42, 43 can be positioned one beside the other.

Figure 4:
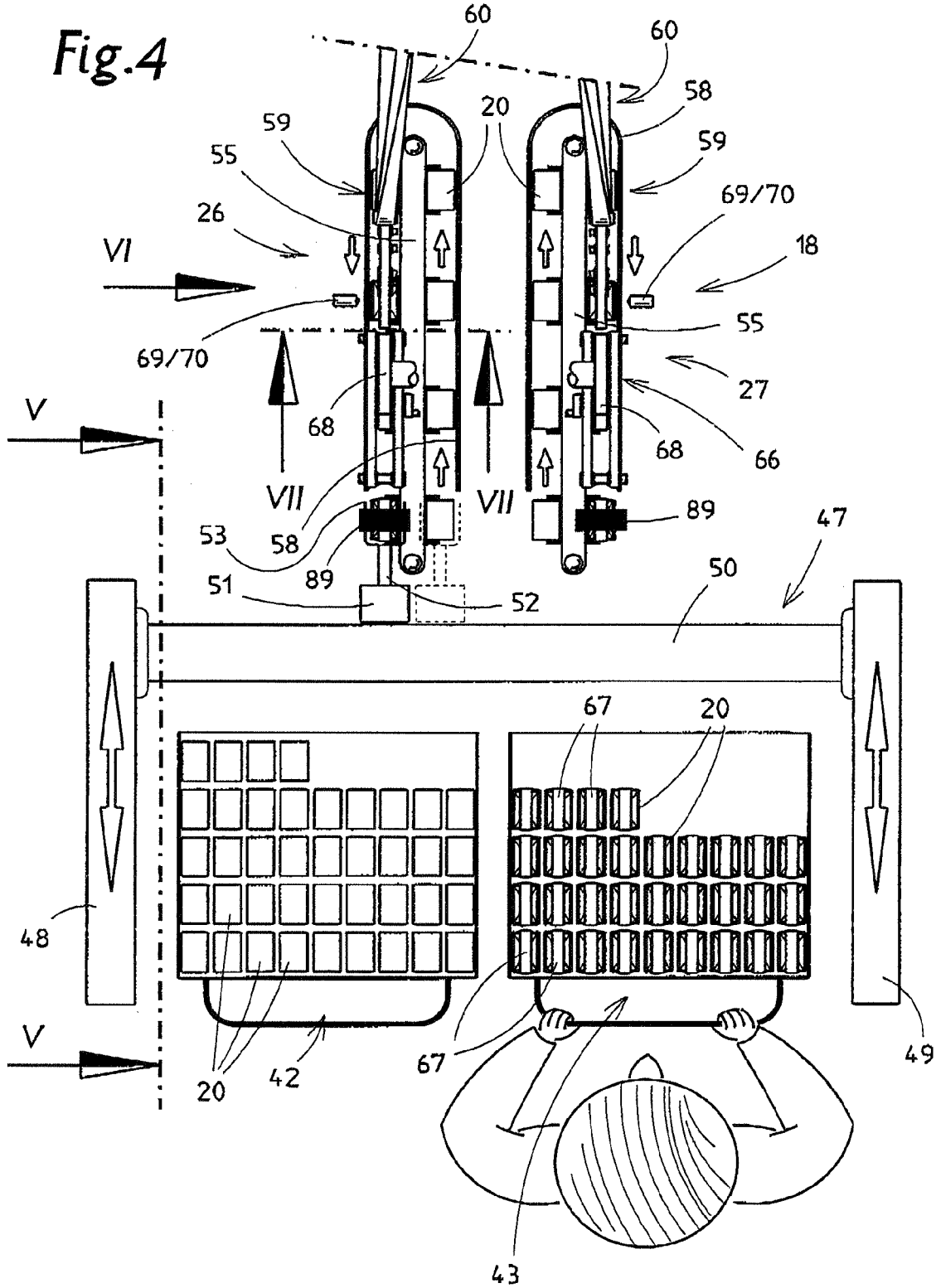
FIG. 4 shows, on an enlarged scale, a detail of the arrangement which is marked IV in FIG. 1.
Figure 5:
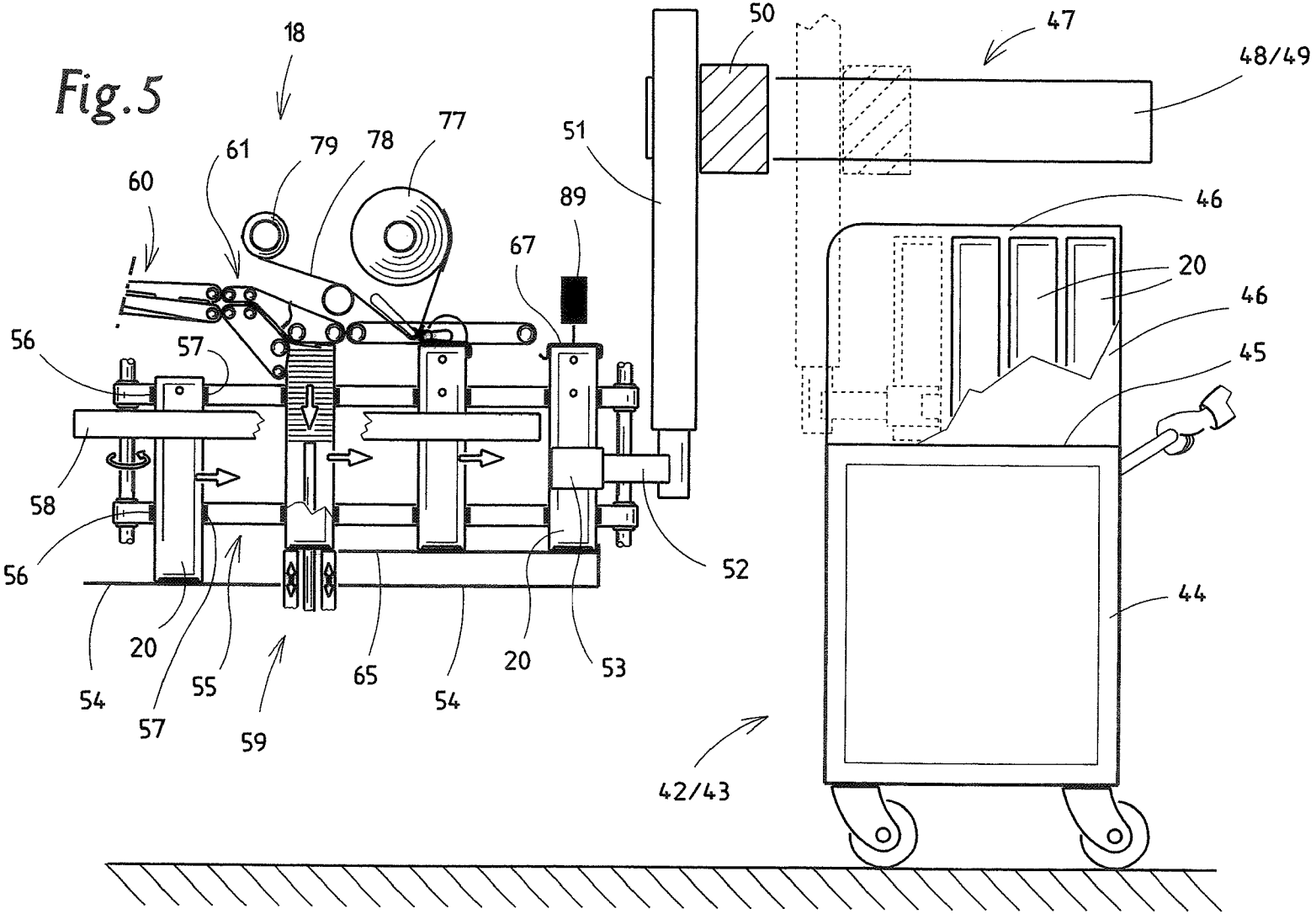
FIG. 5 shows the apparatus according to FIG. 4 in side view and in cross section along section plane V-V in FIG. 4.

The conveyors or transporting carts 42, 43 are also intended for returning empty magazines 20 (transporting cart 42 in FIG. 4). The filling station 18 and/or the filling subassemblies 26, 27 operates/operate so as to accommodate empty magazines, by removal from the transporting cart 42. The filled magazines 20 are guided back and set down on the bearing plate 45 of the other transporting cart 43. For this purpose, the filling station 18 is assigned a lifting and conveying arrangement, namely a gantry-type conveyor 47. The latter comprises two spaced-apart longitudinal members 48, 49, laterally alongside the parking position of the transporting carts 42, 43. A transverse member 50 can be displaced, in accordance with the double arrow, on the fixed longitudinal members 48, 49. In one of the end positions (FIG. 4), the transverse member 50 is directed toward the filling subassemblies 26, 27. A means for accommodating the magazines 20 is fitted on the transverse member 50, to be precise such that it can be displaced in the longitudinal direction of the transverse member 50, that is to say transversely to the longitudinal members 48, 49. The accommodating means comprises an upright carrying arm 51, which is fitted on the transverse member such that it can be moved up and down and can be displaced in the transverse direction. The carrying arm 51 has a securing means for a respective magazine 20 at the bottom end. In the case of the present exemplary embodiment, the securing means comprises a transversely projecting leg 52 and a (clamping) holder 53 which is arranged at the end thereof and is intended for gripping the magazine 20 laterally. The holder 53 or the leg 52 can be rotated about a vertical axis of the upright carrying arm 51, with the result that different angle positions are possible for the purposes of accommodating the magazine 20, and setting it down, in a precisely positioned manner.

Empty magazines 20 are fed one after the other to one filling subassembly 26, 27 or the other and correspondingly filled magazines 20 are taken back and set down on the relevant transporting cart 42, 43. During this transportation of the magazines 20, the transverse member 50 is displaced along the longitudinal members 48, 49, the carrying arm 51 is adjusted on the transverse member 50 as required and, finally, for precise positioning, the leg 52 with holder 53 is pivoted.

The empty magazines 20 are set down on an underlying surface 54 of the filling subassembly 26, 27, namely on a bottom supporting plate. The set-down position is selected such that the magazine 20 can be gripped and transported away by a conveyor of the filling subassembly 26, 27. This is a magazine conveyor 55, which comprises two endless belts which are spaced apart one above the other. These are arranged centrally within the filling subassembly 26, 27 and transport the magazines 20 one after the other along a U-shaped movement path, the magazines 20 being supported for sliding action on the underlying surface 54. The magazine conveyor 55 or the belts thereof has/have carry-along elements, namely in each case two carry-along elements 56, 57 which are spaced apart from one another in accordance with the transverse dimensions of a magazine 20. In each case one magazine 20 is positioned between these carry-along elements. An all-round guide wall 58 is provided as an outer guide, the magazines 20 butting with sliding action against this guide wall during transportation. The guide wall 58, which runs along both sides, is open, and set back, on the side which is directed towards the gantry-type conveyor 47, with the result that it is possible for the magazines 20 to be transferred to the magazine conveyor 55 and/or set down on the underlying surface 54.

The empty magazines 20 are transported into the filling region by a strand of the magazine conveyor 55, to be precise in the region of a returning conveying path of the magazines 20, in the case of the exemplary embodiment according to FIG. 4 in each case in the region of outer movement paths. The cyclically transported magazines 20 here pass into the region of a filling location 59 beneath one end of introduction conveyors 60. These follow the transfer conveyors 39, 40 and cause the coupons 11 to be fed to the magazine 20 which is kept in the filling location 59 in each case. The introduction conveyors 60 are formed by a corresponding arrangement of deflecting rollers such that, during transportation, the coupons 11 are rotated back into an essentially horizontal relative position. The coupons 11 are introduced directly into the respective magazine 20 by a filling conveyor 61, which comprises two interacting belts which are guided over a plurality of deflecting rollers and of which a top belt has a horizontal sub-region extending into a top introduction opening of the magazine 20 and the other belt has an upright supporting section extending in the region of an upright sub-opening of the magazine 20, with the result that each coupon 11 is guided precisely between two belts and is deposited in the magazine 20 to form a coupon stack 19. The incoming coupons 11 here are conveyed in the direction of an upright magazine wall located opposite the inlet side. A sensor 62 checks the correct introduction of the coupons 11 or the correct feed of the same.

Figure 6:
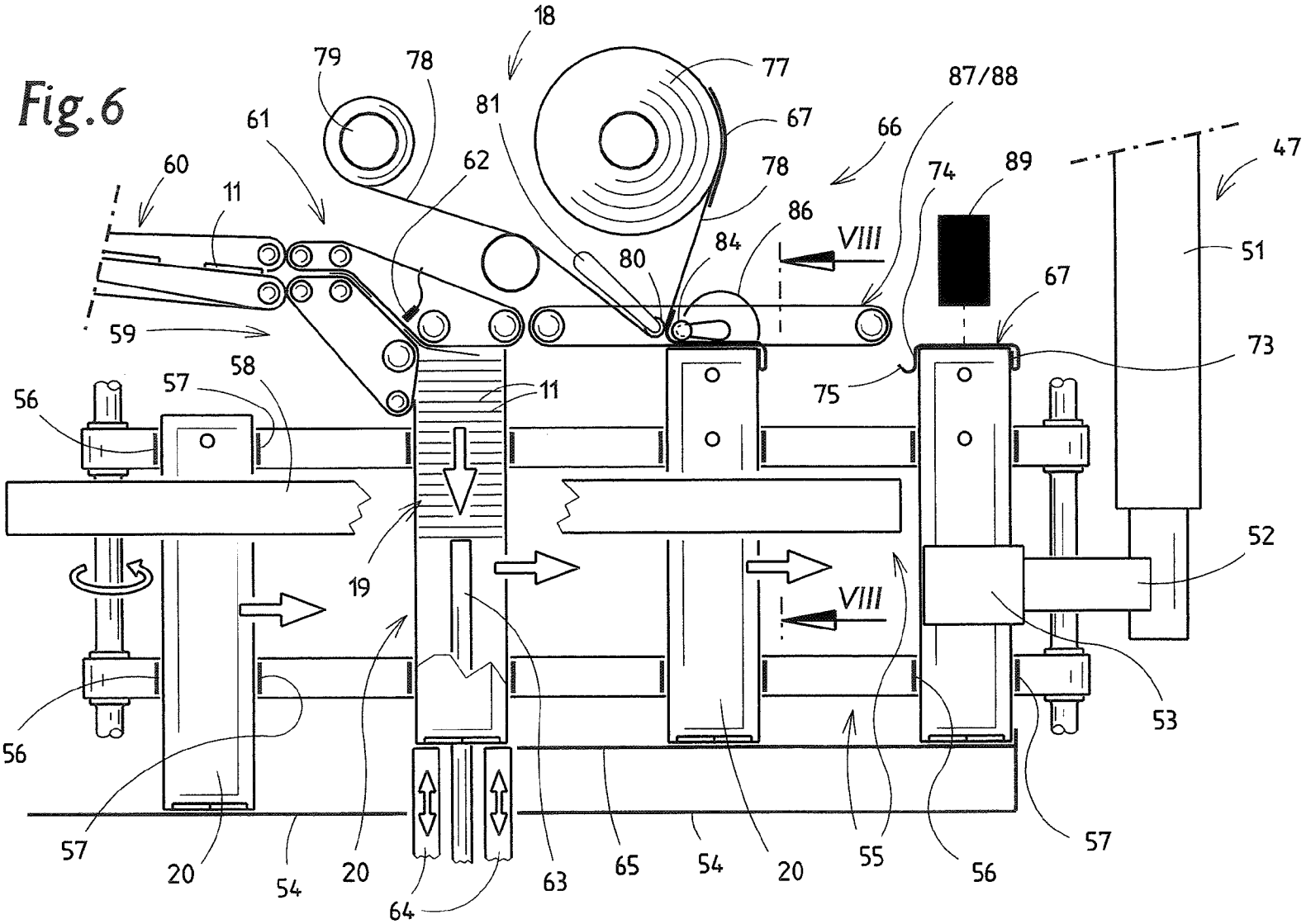
FIG. 6 shows, on an enlarged scale, a detail of the apparatus according to FIG. 4 in side view in the direction of arrow VI in FIG. 4.

Accordingly, the coupon stack 19 formed in the magazine 20 is built up from above, the coupons 11 within the magazine 20 resting on a lowerable support. This is formed by (two) upright supporting push rods 63, which, via openings in a bottom wall of the magazine 20, are moved upward within the latter and, during the filling operation, are lowered from a top, starting position, as the degree of filling in the magazine 20 progresses, until the magazine 20 has been filled completely. For the filling operation, the (initially empty) magazines 20 are raised, using lifting push rods 64, from the plane of the underlying surface 54 to a higher-level platform 65. Processing means, that is to say the filling conveyor 61, are positioned such that the magazines 20 have to be raised, in relation to the feeding plane, to the level of the platform 65. The lifting movement takes place relative to the magazine conveyor 55, namely relative to the two belts of the same. The difference in level for the magazines 20 is caused by the relative position of processing means, in particular by the position of the filling conveyor 61. The lifting movement of the magazine 20 results in the latter passing directly and precisely into the filling position alongside and/or beneath the filling conveyor 61 (FIG. 6).

The filling operation within the magazine 20 is monitored from the outside, to be precise by sensors 69, 70. These check the correct position of the coupons 11 and the progression of filling in the top region of the magazine. The sensors 69, 70 are directed onto the coupon stack 19 via openings 71 in an upright side wall of the magazine 20. Any incorrect positioning of the coupons 11 in the magazine 20 triggers an error signal.

Following the filling location 59, the filled magazines 20 are fed by the magazine conveyor 55 to a closure station 66. In the latter, the filled magazines 20, which are open on the top side, are (partially) closed by having a closure means, namely a closure strip or a tape 67, applied. This is necessary because the magazines 20, for use in the packer 13, are turned such that the open side, which is directed upward during filling, is turned downward for removal of the coupons. The closure means or the tape 67 is removed for this purpose.

Arranged in the region of the closure station 66 is a tape subassembly 68 which is designed, and operates, in a particular manner and is intended for applying the closure strip or the tape 67.

The tape 67 is preferably designed such that it is anchored in a releasable manner by adhesive bonding on the outside of mutually opposite upright walls of the magazine 20. In order for the tape 67 to be easily removed by being pulled off (manually), a leg 73 is formed at one end of the tape 67 by folding over, to be precise by folding over one tape end through 180°. This leg 73 is connected to the magazine 20 in the top region by adhesive bonding. The tape 67, which extends transversely over the open side of the magazine 20, is fastened, likewise by adhesive bonding, on the opposite side of the magazine 20 by way of a downwardly directed endpiece 74. An adhesive-free gripping tab 75 allows the tape 67 to be removed, in particular, manually when the filled magazine 20 is opened for the first time.

A tape subassembly 68 for applying the strip or tape 67 constitutes a special feature. The tapes 67 are provided on a carrier band 78 which is pulled off from a reel 77, to be precise above the movement path of the magazines 20. The tapes 67 are designed such that areas of glue are applied to opposite sides, at the end regions in each case, for the purpose of connecting the leg 73 and the endpiece 74 to the magazine 20. On account of the design of the tape 67, the areas of glue are located on opposite sides of the tape 67. The empty carrier band 78 is wound as an empty reel 79. The carrier band 78 is guided around a press-on roller 80 and deflected from a downward direction into an upward direction. In the region of this deflection, the tape 67 is transferred to the magazine 20, to be precise in a functional sequence according to FIGS. 9 to 12, with continued conveying movement of the magazine 20. The latter is moved past the tape subassembly 68, and receives the tape 67 in the process.

Figures 9, 10, 11, 12:
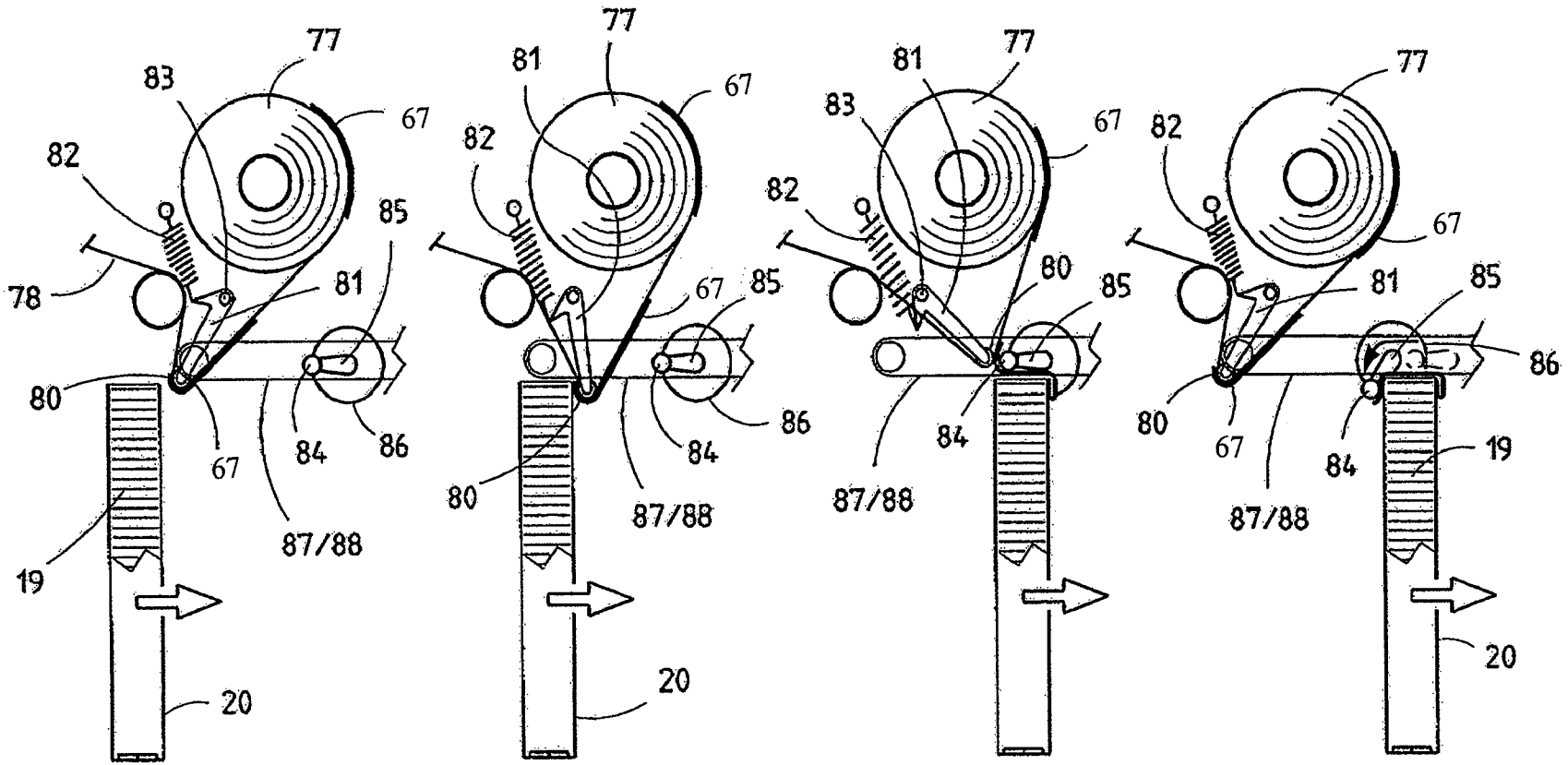
FIGS. 9 to 12 show details of the apparatus according to FIG. 6 in successive movement phases, in side view.

The press-on roller 80 is fitted on a pivotable carrying lever 81. The latter is biased into a certain starting position (FIG. 9), in a direction counter to the incoming magazine 20, by a (tension) spring 82. The relative positions of the carrying lever 81 and the press-on roller 80 are selected such that a top border region of the incoming magazine 20 comes into contact with the press-on roller 80 and pivots the carrying lever 81, with continued movement counter to the biasing of the spring 82, counterclockwise about a rotary bearing 83, namely in the conveying direction of the magazine 20. In this case, in the first instance, the leg 73 with the adhesive layer is pressed onto the magazine 20 (FIG. 10). Thereafter, as pivoting of the carrying lever 81 continues, the press-on roller 80 moves along the top side of the magazine 20, pressing on the tape 67 in the process. In an end position of the press-on roller 80 and carrying lever 81 (FIG. 11), the carrying lever 81 is freed and is moved back into the starting position by the spring 82 (FIG. 12).

The operation of applying the tape 67 is then completed by a pressure-exerting roller 84. The latter is mounted in a stationary manner on a pivoting lever 85 above the movement path of the magazine 20. The pivoting lever 85 can be moved by a drive, namely by a motor 86. The latter executes, via a shaft, a (controlled) pivoting movement of the pivoting lever 85, the pressure-exerting roller 84 being pressed onto the tape 67 in the process. The movement of the pivoting lever 85 and thus of the pressure-exerting roller 84 are controlled such that, in an end position (FIG. 12), the pressure-exerting roller 84 folds the endpiece 74 of the tape 67 over a top edge of the magazine 20 into an upright plane, the endpiece 74 with the adhesive being pressed onto the upright side wall of the magazine 20 in the process.

Figure 8:
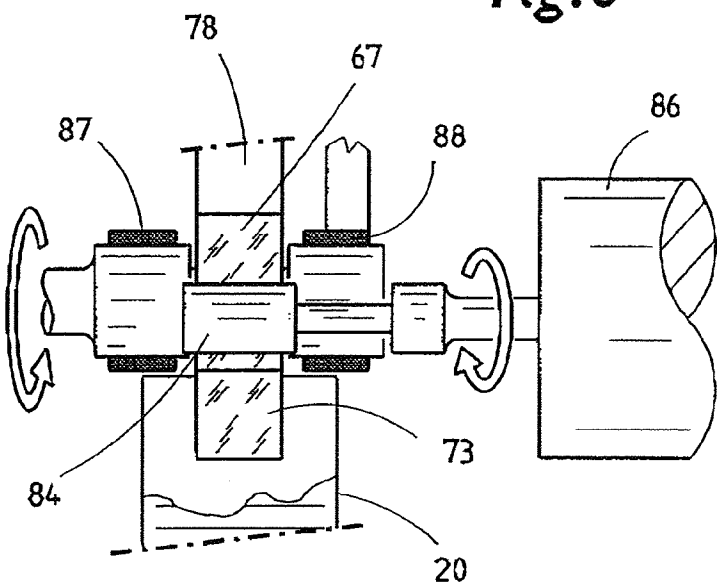
FIG. 8 shows a detail of the apparatus in FIG. 6 along a transversely directed section plane VIII-VIII.
Figure 7:
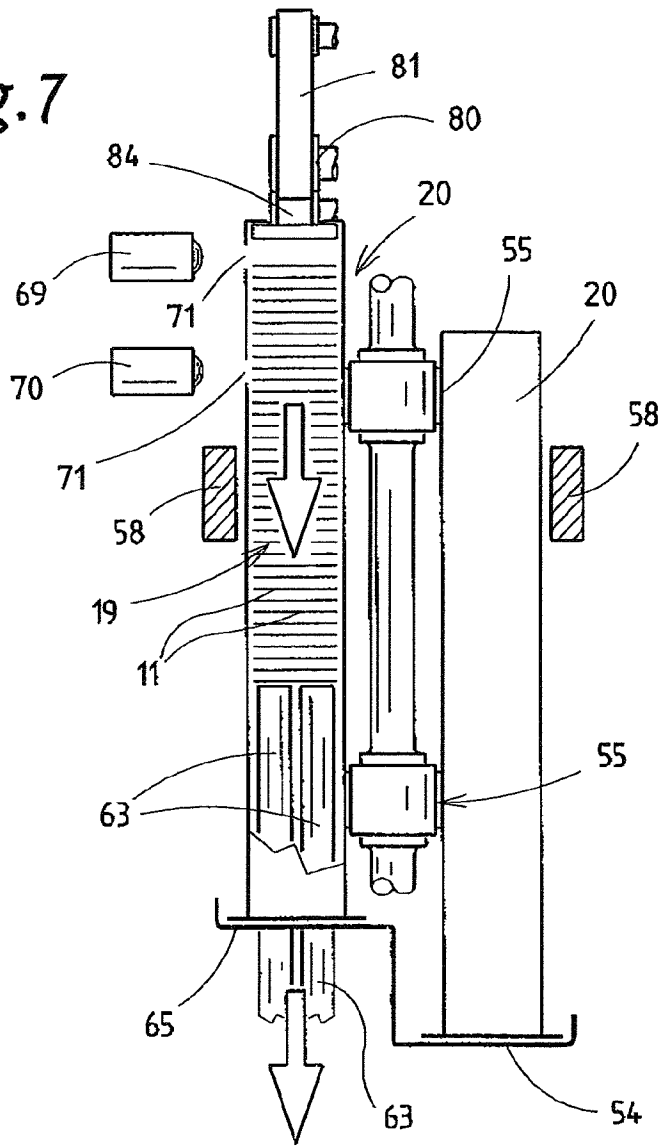
FIG. 7 shows a detail of the apparatus according to FIG. 4 in cross section along section plane VII-VII.

In the region of the tape subassembly 68, the magazines 20, which are open at the top, are assigned a holding-down means. This is formed by two endless belts 87, 88 which grip the magazine 20 at peripheral regions of the open side (FIG. 8). The preferably driven endless belts 87, 88 cause the coupons 11 stacked in the magazine 20 to be pressed down counter to a material-induced restoring force of the folded coupons 11.

It is particularly important to integrate production and handling of the coupons 11 in the production process of the packs. A basic precondition for this is the labelling or marking of the magazines 20 with coupons 11 of a certain configuration. The marking takes place in the region of the detachable closure means, namely of the tape 67. In particular a readable code, for example a bar code, is applied to the tape 67 by printing. For this purpose, the filling station 18 is provided with a printer 89 above the movement path of the magazines 20 following the closure station 66, for the purpose of printing the (bar) code on the tape 67.

The processing machine, that is to say the packer 13, is provided with a reader 90 for the code on the magazine 20 or on the tape 67. The reader 90 is positioned, in particular, in the region of the magazine carousel 21, with the result that accuracy is checked at this location, namely prior to the coupons 11 being introduced into the packer 13.

In order to integrate coupon production in a (central) control means of the packaging installation, the coupon arrangement 15 or the coupon-production means 16 is connected to a central control unit 91. The latter is likewise connected to the packaging installation 12. The production of a certain type of (cigarette) pack including associated coupon 11 is entered as a program into the central control unit 91 or into a computer of the same. Accordingly, the quantity of packaging material, pack contents and the quantity of coupons 11 which are to be produced are calculated. The packaging material is made available to the machines. Furthermore—in advance of production of the packs—coupon production is initiated, the quantity of coupons 11 which are to be produced being predetermined and the printer 89 being activated in order to apply the code. Finally, the quantity of coupons 11 which is necessary for the relevant batch of packs is kept on one or more transporting carts 42, 43, where possible in a separate store in the vicinity of the machines. At the beginning of pack production, the coupons 11 or magazines 20 are called up and the transporting carts 42, 43 are fed to the machines or the packer 13 in accordance with the quantity which is to be produced. The magazines 20 may also be transported by way of automatically operating vehicles, to be precise either ground-level vehicles or transporting equipment which can be displaced on overhead conveyors. It is also the case that the magazine carousel 21 and the reader 90 are connected to the control unit 91, with the result that detected errors in the region of the magazines 20 lead directly to an error signal being triggered. In the case of automatic conveying arrangements for the coupons or magazines, it is also possible for the conveying installations to be connected to the control unit 91. Furthermore, it is alternatively or additionally possible for codes to be applied to the transporting cart 42, 43 itself, to be precise even such information as can be read directly. Corresponding marking cards or other data carriers may be produced directly by the printer 89 and applied to the transporting cart 42, 43.

LIST OF DESIGNATIONS

11 Coupon
12 Packaging installation
13 Packer
14 Cellophane wrapper
15 Coupon arrangement
16 Coupon-production means
17 Distributor system
18 Filling station
19 Coupon stack
20 Magazine
21 Magazine carousel
22 Web
23 Folding subassembly
24 Severing means
25 Severing cutter
26 Filling subassembly
27 Filling subassembly
28 Receiving belt
29 Receiving belt
30 Receiving belt
31 Receiving belt
32 Intermediate conveyor
33 Intermediate conveyor
34 Connection conveyor
35 Connection conveyor
36 Collecting conveyor
37 Entry conveyor
38 Distributor
39 Transfer conveyor
40 Transfer conveyor
41 Directing means

42 Transporting cart
43 Transporting cart
44 Undercarriage
45 Bearing plate
46 Supporting wall
47 Gantry-type conveyor
48 Longitudinal member
49 Longitudinal member
50 Transverse member
51 Carrying arm
52 Leg
53 Holder
54 Underlying surface
55 Magazine conveyor
56 Carry-along element
57 Carry-along element
58 Guide wall
59 Filling location
60 Introduction conveyor
61 Filling conveyor
62 Sensor
63 Supporting push rod
64 Lifting push rod
65 Platform
66 Closure station
67 Tape
68 Tape subassembly
69 Sensor
70 Sensor
71 Opening
73 Leg
74 Endpiece
75 Gripping tab
77 Reel
78 Carrier band
79 Empty reel
80 Press-on roller
81 Carrying lever
82 Spring
83 Rotary bearing
84 Pressure-exerting roller
85 Pivoting lever
86 Motor
87 Endless belt
88 Endless belt
89 Printer
90 Reader
91 Control unit

The invention claimed is:

1. An apparatus for handling coupons in the production of packs with at least one coupon applied to each pack, the coupon (11) having been folded a number of times, wherein the coupon is removed from a magazine (20), in a region of a packer (13) and fed to the pack, characterized by the following features:

a) the coupons (11) are produced by a coupon-production means (16) in a region of a separate coupon assembly (15), b) the coupon-production means (16) is followed by a distributor system (17) for feeding the coupons (11) one after the other to a filling station (18), c) upright magazines (20) are kept in a region of the filling station (18), wherein the coupons (11) are conveyed one after the other into the magazines (20), which are open at the top, by a filling conveyor (61), and wherein a coupon stack (19) is formed within each magazine (20), and d) the magazines (20) filled with coupons (11) are set down on a transporting cart (42, 43) for transporting a selected number of magazines (20) to the packer (13).

2. The apparatus as claimed in claim 1, characterized in that a separate coupon assembly (15) comprises a coupon-production means (16), a following distributor system (17) and a subsequent filling station (18), wherein a plurality of coupons (11) are produced simultaneously in a region of the coupon-production means (16) and are fed separately and one after the other to the filling station or the filling conveyor (61) by the distributor system (17).

3. The apparatus as claimed in claim 1, characterized in that the distributor system comprises a plurality of successive endless receiving belts (28, 29, 30, 31), by means of which, as a result of different conveying speeds, a spacing is produced between the simultaneously produced coupons (11), intermediate conveyors (32, 33) and connection conveyors (34, 35), and a collecting conveyor (36) by means of which the coupons (11) which are fed in a plurality of paths are brought together into a common path for transfer to an entry conveyor (37).

4. The apparatus as claimed in claim 3, characterized in that the coupons arriving one after the other, in a region of the entry conveyor (37) to the filling station (18), are distributed over at least two transfer conveyors (39, 40), which are each assigned to one of two filling subassemblies (26, 27).

5. The apparatus as claimed in claim 1, characterized in that, in a region of the filling station (18), the upright magazines (20) are transported one after the other, by a magazine conveyor (55), into a filling location (59) beneath the filling conveyor (61), and in that the filled magazines (20) are conveyed by the magazine conveyor (55) into a subsequent closure station (66) for the purpose of applying a closure to an upwardly oriented open side of the magazine (20), for the purpose of applying a transversely directed closure tape (67).

6. The apparatus as claimed in claim 5, characterized in that the tape (67) is applied to the top side of the magazine in a region of the closure station (66) by a tape subassembly (68), wherein the magazine (20) is conveyed relative to the tape subassembly (68) by the magazine conveyor (55) in order for the tape (67) to be applied.

7. The apparatus as claimed in claim 6, characterized in that, in a region of the tape subassembly (68), the tape (67) is pressed onto side walls and onto the top side of the magazine (20) by a spring-biased press-on roller (80), wherein the press-on roller (80), which is movable counter to pressure is moved by the transported magazine (20) out of a press-on position for the tape on a side wall and over the top side of the tape while guiding the tape (67) in the process.

8. The apparatus as claimed in claim 7, characterized in that tapes (67) are arranged on a continuous carrier band (78), and in that the spring-biased press-on roller (80) butts against the carrier band (78) on a side thereof which is directed away from the tapes (67).

9. The apparatus as claimed in claim 6, characterized in that the tape (67) is folded in a U-shaped manner around a top side of the magazine (20), with a leg (73) on one side and an endpiece (74) on the opposite side, two press-on elements causing the tape (67) to be transferred from the carrier band (78) to the magazine, said elements comprising the press-on roller (80), on the one hand, and a separately moveable pressure-exerting roller (84), on the other hand.

10. The apparatus as claimed in claim 5, characterized in that arranged in a region of the filling station (18), following the closure station (66) for applying the tape (67), is a printing unit (89) for applying production-related data or codes to the tape (67).

11. The apparatus as claimed in claim 1, characterized in that the magazines (20) filled in a region of the filling station (18) are removed from the filling station (18) and set down, on a bearing plate (45) of a transporting cart (42, 43), by a gantry-type conveyor (47), the gantry-type conveyor (47) comprising two longitudinal members (48, 49), a transverse member (50), which is movable along the longitudinal members (48, 49), and a carrying arm (51) which is movable up and down on the transverse member (50) and has a holder (53) for magazines (20).

12. The apparatus as claimed in claim 1, characterized in that the coupon-production means (16), and/or a printer (89) and/or the packer (13) and/or a reader (90) for markings on the magazines (20) are connected to a control unit (91) for controlling the coupon production in dependence on requirements in a region of the packer (13) and for corresponding coding of the magazines (20) and/or of the transporting cart (42, 43).

* * * * *